US006324876B1

(12) United States Patent
Prevot et al.

(10) Patent No.: US 6,324,876 B1
(45) Date of Patent: Dec. 4, 2001

(54) RETURN DEVICE FOR AN OPERATING MEMBER FOR A LOCK, ESPAGNOLETTE-LOCK OR THE LIKE

(75) Inventors: Gérard Prevot, deceased, late of Willerwald, by Nadine Prevot, heiress; Jean-Yves Collet, Saint Jean-Saverne, both of (FR)

(73) Assignee: Ferco International Ferrures et Serrures de Batiment, Reding (FR)

( * ) Notice: Subject to any disclaimer, the term of this patent is extended or adjusted under 35 U.S.C. 154(b) by 0 days.

(21) Appl. No.: 09/384,857

(22) Filed: Aug. 27, 1999

(51) Int. Cl.[7] ..... E05B 59/00
(52) U.S. Cl. ..... 70/107; 70/109; 292/34
(58) Field of Search ..... 70/172, 107–109; 292/34–40, 51

(56) References Cited

U.S. PATENT DOCUMENTS

| | | | | |
|---|---|---|---|---|
| 4,962,653 | * | 10/1990 | Kaup | 70/107 |
| 5,096,237 | * | 3/1992 | Hotzl | 292/34 |
| 5,171,047 | * | 12/1992 | Korb et al. | 292/39 |
| 5,265,920 | * | 11/1993 | Kaup et al. | 292/40 |
| 5,301,525 | * | 4/1994 | Doring | 70/107 |
| 5,752,727 | * | 5/1998 | Zues et al. | 292/34 |
| 5,896,763 | * | 4/1999 | Dinkelborg et al. | 70/108 X |
| 6,007,114 | * | 12/1999 | Hotzl | 292/34 |
| 6,050,115 | * | 4/2000 | Schroter et al. | 70/107 |
| 6,109,666 | * | 8/2000 | Collet | 292/39 |

FOREIGN PATENT DOCUMENTS

| | | |
|---|---|---|
| 0 359 284 | 3/1990 | (EP) . |
| 2 569 755 | 3/1986 | (FR) . |
| 2 747 422 | 10/1997 | (FR) . |

* cited by examiner

*Primary Examiner*—Suzanne Dino Barrett
(74) *Attorney, Agent, or Firm*—Kenyon & Kenyon

(57) ABSTRACT

A return device for an operating member engaged with a nut comprises a body having on a front face arrangements which cooperate with complementary arrangements on the nut to convert rotation of the nut about its axis into longitudinal movement of the body. The ends of the body comprise respective pairs of branches forming forks extending in the longitudinal direction of the body. The body has a longitudinal internal cavity to accommodate a spring open at both ends of the body. The width of the longitudinal internal cavity is greater than the distance between the branches of the forks. The longitudinal internal cavity has at least one portion opening onto a rear face of the body and having the spring passed through it. Uses include in a casing for a lock, espagnolette-lock or the like.

12 Claims, 3 Drawing Sheets

RETURN DEVICE FOR AN OPERATING MEMBER FOR A LOCK, ESPAGNOLETTE-LOCK OR THE LIKE

BACKGROUND OF THE INVENTION

1. Field of the Invention

The present invention concerns a return device for an operating member of a lock adapted to be embedded within the thickness of an opening panel.

It also concerns a casing of a lock, espagnolette-lock or the like of the above kind for doors, windows, french doors or the like.

2. Description of the Prior Art

In the prior art there are many examples of espagnolette-locks of the above type which are generally adapted to operate simultaneously a catch bolt, a lock bolt and at least one locking rod or one actuator rod of locking accessories such as rollers cooperating with a keeper in the fixed frame.

In a espagnolette-lock of the above kind, as described in French patent application 2 747 422 in the name of the Applicant, a nut is attached to an operating member such as a door handle which engages at least with an operating square pin at the center of the nut.

Rotating the nut one way operates the catch bolt against a return spring which holds the catch bolt projecting from the lock front plate.

The nut also cooperates with a bracket to the ends of which the espagnolette bolts are fixed so that the espagnolette rods are deployed or retracted according to the direction in which the nut turns.

After each rotation of the operating member it and the nut that rotates with it must be returned to their original position.

To this end, the aforementioned patent application describes a spring cooperating with a member which is mobile inside the lock casing and is adapted to move in a longitudinal direction when the nut turns on its axis. Pinion means centered on the nut axis are adapted to mesh with the teeth of a rack attached to the mobile member.

The spring lies inside a housing formed in the casing and the mobile member has two projecting parts adapted to engage with respective ends of the spring.

The spring housing supports the rack of the mobile member and includes a plate adapted to engage in a corresponding opening at the rear of the lock casing.

However, an operating member return device of the above kind has a large number of parts (housing, spring, mobile member carrying the rack) and requires a large number of assembly operations to fix the assembly into the casing of the espagnolette-lock.

French patent 84 13 687 in the name of Establishments DREVET et CIE discloses a lock for doors or the like comprising a casing enclosing a nut for operating the catch bolt returned to a rest position by a spring member. A sliding member carrying a rack adapted to mesh with the teeth of a pinion attached to the nut includes a housing containing the spring member. The latter member is between the back of the housing and a transverse shaft fastened to the casing which is adapted to compress the spring member when the sliding member moves longitudinally in response to rotation of the nut.

However, a nut return device of the above kind is not suitable as a return spring for a nut which can turn about its axis in both directions.

Furthermore, the spring member cannot escape from the housing in the sliding member when the latter is fixed to the casing, as the transverse shaft of the casing then cooperates with the open end of the sliding member through which the spring member is inserted.

An object of the present invention is to overcome the aforementioned drawbacks and to propose a return device for an operating member that is simpler to manufacture and to fit.

SUMMARY OF THE INVENTION

The invention consists in a return device for an operating member engaged with a nut, the device comprising a body having on a front face means adapted to cooperate with complementary means on the nut to convert rotation of the nut about its axis into longitudinal movement of the body, wherein the ends of the body comprise respective pairs of branches forming forks extending in the longitudinal direction of the body, the body has a longitudinal internal cavity adapted to accommodate a spring and open at both ends of the body, the width of the longitudinal internal cavity is greater than the distance between the branches of the forks, and the longitudinal internal cavity has at least one portion opening onto a rear face of the body and adapted to have the spring passed through it.

Thus the body supporting the rack also forms a housing for the return spring and the return device has only two parts, namely the body and the spring, apart from the parts of the walls of the casing that retain it when it slides.

Because of the difference between the width of the longitudinal internal cavity in the body and the distance between the branches of the fork, the latter form right-angle shoulders at the base of the forks, i.e. at the ends of the longitudinal internal cavity. These shoulders serve as abutments for the spring housed in the internal cavity.

The spring can therefore be accommodated and held in the body of the return device regardless of whether the device is mounted on the lock casing or not.

Furthermore, the symmetrical ends of the body and the presence of the two forks mean that the spring can be compressed regardless of the direction in which the nut turns and therefore regardless of the direction of longitudinal displacement of the body of the return device.

In an advantageous version the longitudinal internal cavity is a notch opening onto the rear face of the body and intersected by at least one bridge substantially transverse to the longitudinal direction of the body.

The spring can be inserted into the longitudinal internal cavity opening without difficulty from the rear face of the body.

Furthermore, the bridges prevent the spring flexing out of the body of the rack when the spring is compressed.

In accordance with another aspect of the invention a casing for a lock, espagnolette-lock or the like comprises a return device in accordance with the invention and at least one nut for actuating a catch bolt, the rear edge of the casing has two flanges extending towards the interior of the casing and substantially parallel to the back of the casing and the flanges are adapted to be introduced between the branches forming the respective forks of the body of the return device.

Thus the flanges of the casing compress the spring of the return device and guide the body carrying the rack when it moves longitudinally.

Furthermore, it is a very simple matter to mount the return device in the casing: it is sufficient to slide the body parallel to the back of the casing in such manner as to introduce the flanges of the rear edge into the end forks of the body.

Other features and advantages of the invention will become more apparent in the following description.

BRIEF DESCRIPTION OF THE DRAWINGS

In the accompanying drawings, given by way of non-limiting example.

DETAILED DESCRIPTION OF THE PREFERRED EMBODIMENT

Figure 1:
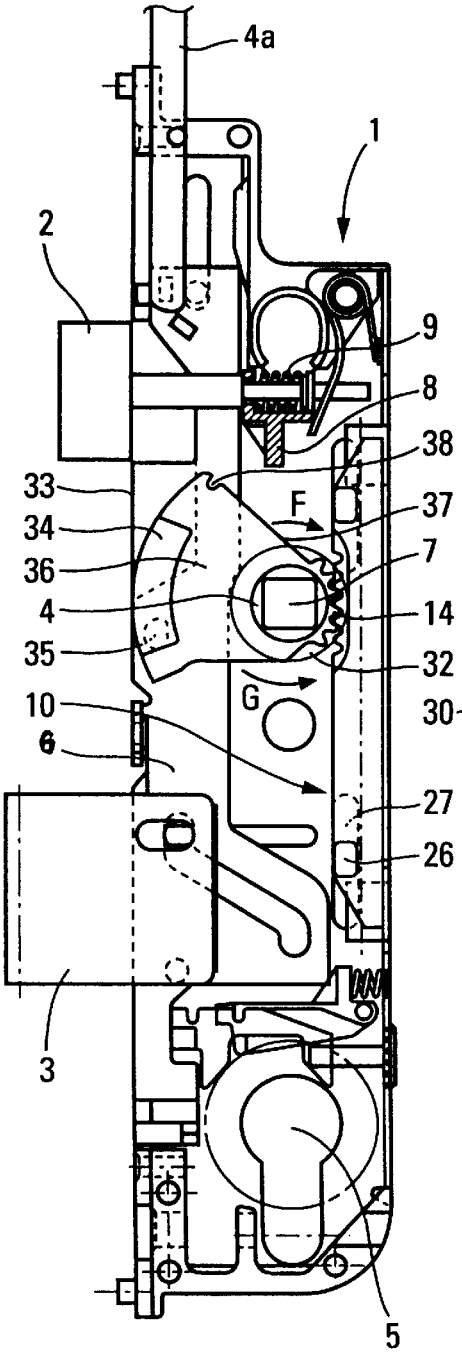
FIG. 1 is an elevation view of an espagnolette-lock casing in accordance with the invention with the cover removed from the casing.

Referring to FIG. 1, an espagnolette-lock casing 1 is adapted to be set into a groove in an opening panel such as a door, window, french door or the like.

The casing 1 houses the operating mechanism of a catch bolt 2, a lock bolt 3 and espagnolette rods 4*a* which are mounted at the ends of a bracket 4 in a manner that is known per se.

A keyhole 5 is also provided to allow the lock bolt to be retracted or deployed by means of a key.

A nut 6 is rotatably mounted in the casing 1 and engages with an operating member such as a door handle by means of a square pin fixed to the center 7 of the nut.

As described in more detail hereinafter, when it turns in a first direction indicated by the arrow F the nut 6 operates on the tail 8 of the catch bolt, against the action of a return spring 9 which holds the catch bolt 2 projecting from the front plate of the casing 1.

The nut 6 also acts on the bracket 4 to retract or deploy the espagnolette rods 4*a* according to the direction in which the nut 6 turns.

FIGS. 4, 5, 6 and 7 show in detail a device for returning the nut 6 and therefore the operating door handle to the rest position.

The return device 10 has a body 11 with a front face 12 carrying means 13 adapted to cooperate with complementary means 14 attached to the nut 6 to convert rotation of the nut 6 about its axis into longitudinal movement of the body 11. The ends of the body 11 have respective branches 15, 16 forming a fork and extending in the longitudinal direction D of the body 11.

The body has a longitudinal internal cavity 17 adapted to accommodate a spring 18 and open at both ends of the body 11.

The width L of the longitudinal internal cavity 17 is greater than the distance 1 between the branches 15, 16 of the fork, the longitudinal internal cavity having portions 17*a*, 17*b*, 17*c*, 17*d* opening onto the rear face 19 of the body 11.

The spring 18 is inserted into the longitudinal internal cavity 17 through at least one of these portions of the internal cavity, preferably a portion 17*a* of the internal cavity adjacent one end of the body 11.

In this example the longitudinal internal cavity is a notch 17 opening onto the rear face 19 of the body 11 and intersected at least by a bridge 20 substantially transverse to the longitudinal direction D of the body 11. For example, the body 11 may incorporate three bridges 20 regularly distributed on the rear face 19 of the body 11 and retaining the spring 18 in the notch 17.

The cross-section of the longitudinal internal cavity 17 is preferably semi-circular to accommodate a conventional coil spring 18.

Because of the difference between the width L of the notch and the distance 1 between the branches 15, 16 of the fork, shoulders 21, 22 are formed at the ends of the longitudinal internal cavity 17 and so form a constriction at the base of the forks adapted to hold the spring 18 between the ends of the internal cavity 17.

The front face 12 of the body 11 includes a rack 13 having teeth 13*a* adapted to mesh with teeth 14 on the nut 6, as shown in FIG. 1.

Figure 5:
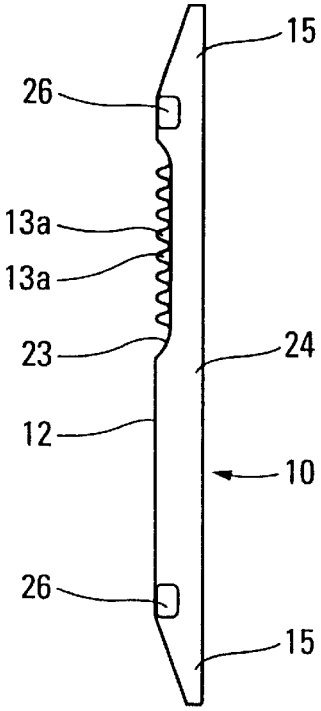
FIG. 5 is a righthand side view of the return device from FIG. 4.

The body 11 has a circular oblong recess 23 in line with the teeth 13*a* of the rack 13 and flush with a side face 24 of the body 11 (see FIG. 5).

The recess 23 is concentric with the center 7 of the nut 6 when the return device 10 is mounted in the lock casing 1.

Figure 6:
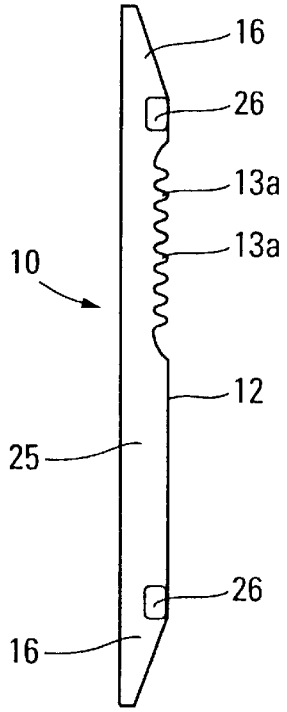
FIG. 6 is a lefthand side view of the return device from FIG. 4.
Figure 7:
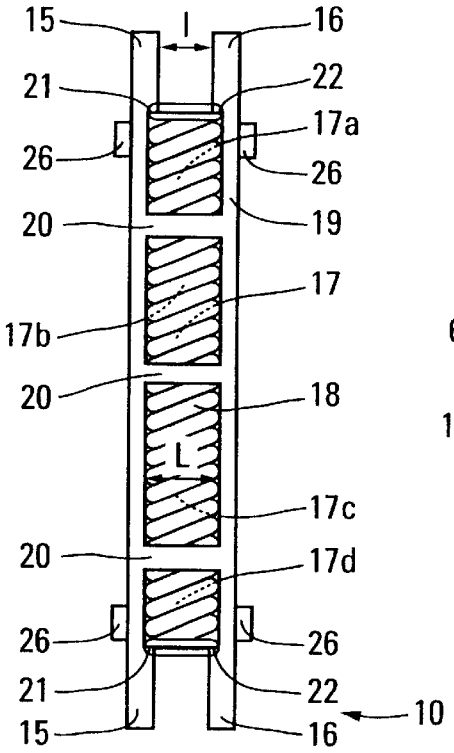
FIG. 7 is a rear view of the return device from FIG. 4.

Furthermore, the teeth 13*a* of the rack 13 are adjacent to a second side face 25 of the body 11, as shown in FIG. 6.

Figure 4:
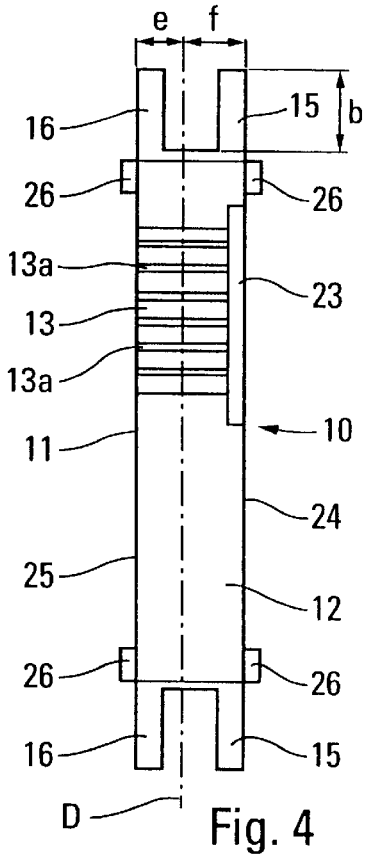
FIG. 4 is a front view of the return device in accordance with the invention.

The median plane of the rack 13, symbolized by the chain-dotted line D in FIG. 4, is therefore asymmetrical relative to the branches 15, 16 of the fork.

The distance e between the median plane D and the second side face 25 of the body 11 is therefore less than the distance f between the median plane D and the first side face 24.

This facilitates mounting the return device in the back of the casing 1, as described hereinafter.

The side faces 24, 25 of the body 11 include guide means 26 adapted to cooperate with complementary guide means 27 on the back and the cover of the casing 1 accommodating the nut 6.

The above return device is of unitary construction and can be cast in a foundry.

The spring 18 can be mounted in the body 11 by inserting the spring 18 through an open portion 17*a* of the rear face 19 at one end of the body 11.

The end of the spring 18 is pushed into the longitudinal opening 17 in the body 11 until it abuts against the shoulders 21, 22 at the end opposite that from which the spring 18 is inserted.

The other end of the spring 18 is inserted into the longitudinal opening 17 by slightly compressing the spring. Because of the elasticity of the spring, when the spring relaxes this other end lines up with the shoulders 21, 22 at the end through which the spring 18 is inserted.

The length of the opening 17 is slightly greater than the length of the notch on the rear face 19 and so the shoulders 21, 22 cap the respective ends of the spring 18.

This design with only two components limits the accumulation of stresses between the parts and therefore enables the use of a spring 18 that is stronger and more resistant to metal fatigue, with the result that the operating member will return to its original rest position for longer. Limiting the accumulation of play guarantees that the operating member returns to the correct rest position.

The lock casing adapted to receive the return device 10 will now be described with particular reference to FIGS. 2, 3 and 6.

The rear edge 28 of the casing 1 incorporates two flanges 29 extending towards the interior of the casing 1 and substantially parallel to the back 30 of the casing 1. The flanges 29 are adapted to be inserted between the branches 15, 16 of the respective forks of the body 11 of the return device 10.

Figure 9:
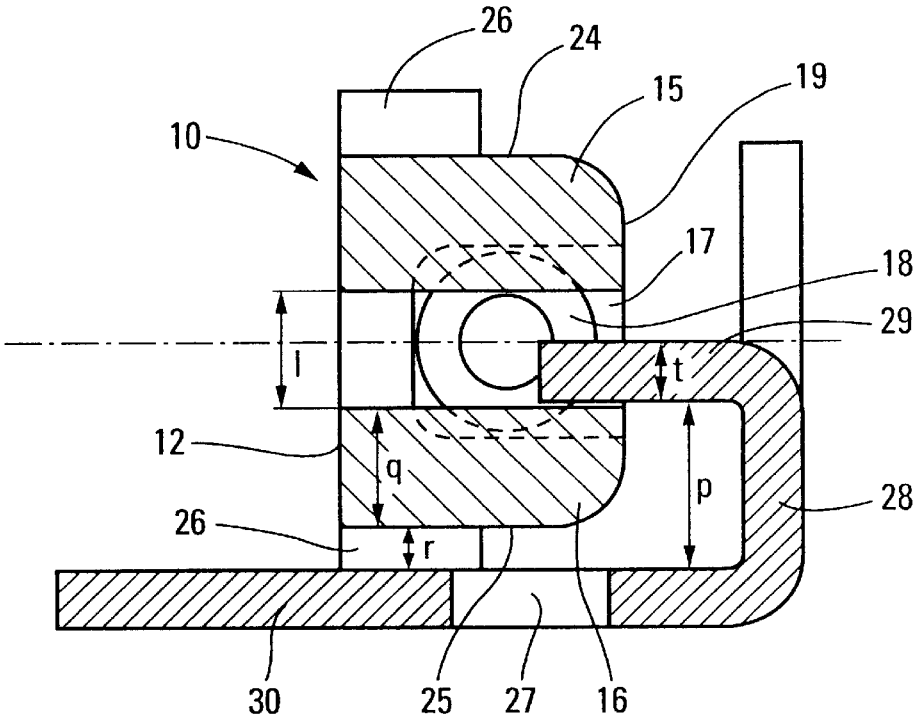
FIGS. 9 and 10 show how the return device is mounted in the lock casing in accordance with the invention.

As shown in FIG. 9, the distance p between the flanges 29 of the back 30 of the casing 1 is greater than or equal to the thickness q of one branch 16 of the forks of the body 11 of the return device 10 plus the thickness r of the guide pin 26 in a direction perpendicular to the side face 25 of said body 11.

Furthermore, the distance 1 between the branches 15, 16 of the forks of said body 11 is greater than or equal to the thickness t of said flanges 29 plus the thickness r of the guide pin 26 in the direction perpendicular to the side face 25 of the body 11.

Figure 2:
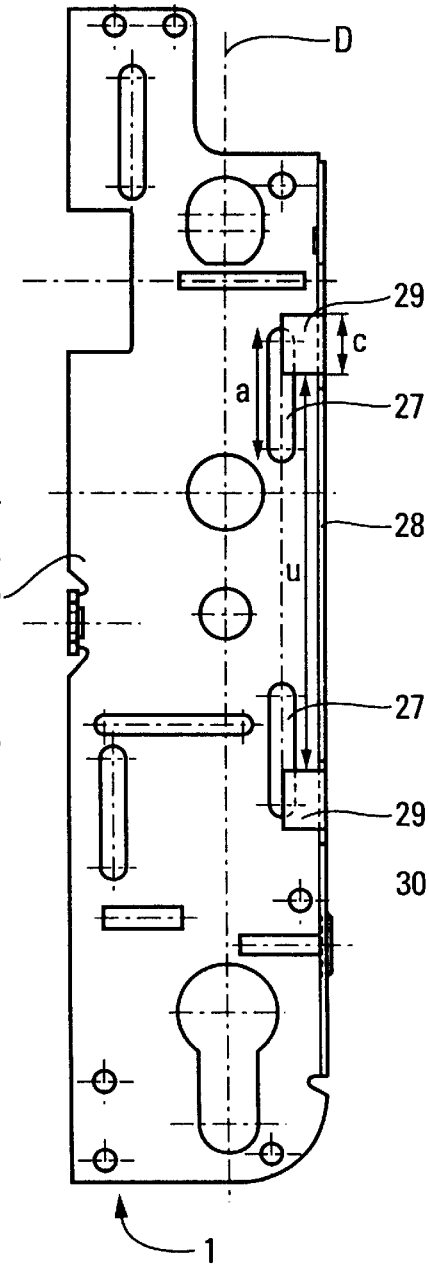
FIG. 2 is a view analogous to FIG. 1 showing the back and the rear edge of the casing.
Figure 3:
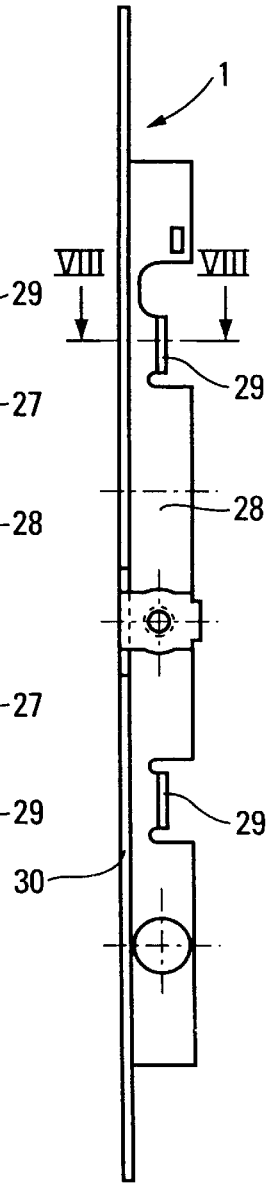
FIG. 3 is a side view of the casing from FIG. 2.

As shown in FIG. 2, the distance u between the flanges 29 of the rear edge 28 of the casing 1 is less than or equal to the length of the spring 18 in the rest position in the body 11.

The flanges 29 can be formed by cutting the material of the rear edge 28 and bending the flanges 29 towards the interior of the casing.

Figure 10:
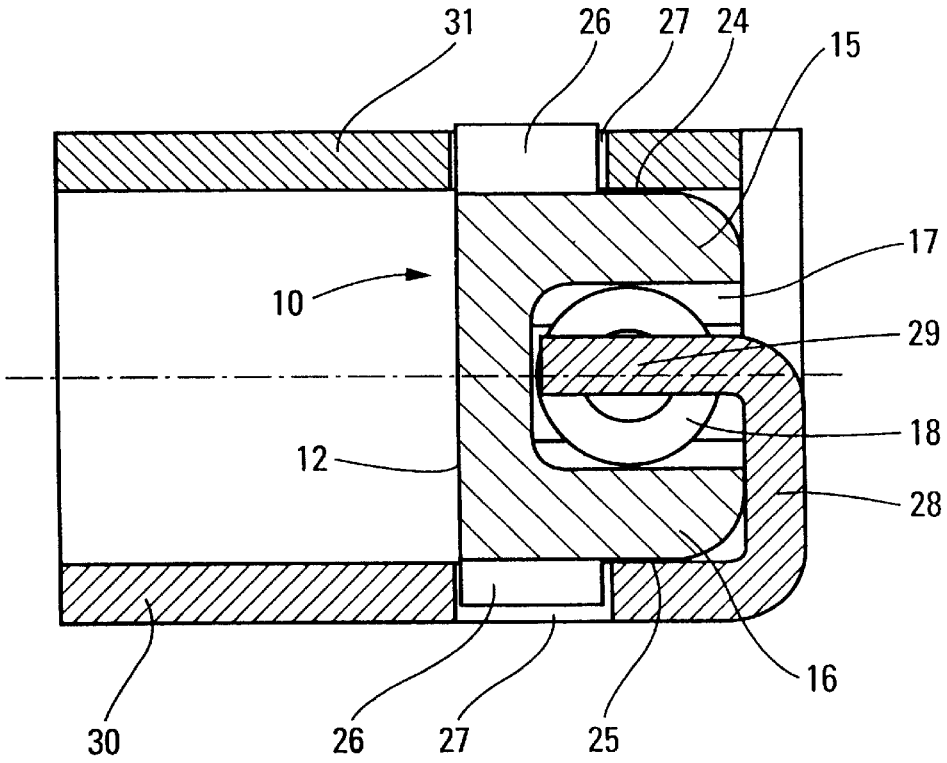

FIGS. 9 and 10 show the mounting of the return device 10 in the casing 1.

The distance p between the flange 29 and the back 30 of the casing 1 being sufficient to receive one branch 16 of the fork and a guide pin 26, the body 11 can be inserted by sliding on the back 30 of the casing 1 until the rear face 19 of the body 11 comes into contact with the rear edge 28 of the casing 1, as shown in FIG. 10.

The openings 27 are provided on the back 30 of the casing so that the guide pins 26 on the body 11 are in line with the openings 27 at the end of the movement of the body 11 along the flanges 29.

Given the sufficient distance 1 between the two branches 15, 16 of the fork, the guide pins 26 are accommodated in the openings 27, the flanges 29 moving transversely between the branches 15, 16 of the fork.

The cover 31 of the casing 1 is then fixed to the casing 1. It also incorporates openings 27, identical to those on the back 30 of the casing 1, to guide movement in translation of the guide pins 26 on the other side face 24 of the body 11.

The openings 27 cooperating with the guide pins 26 have a length a in the longitudinal direction D of the body 10 which is less than or equal to the length b of the branches 15, 16 of the fork plus the height c of said flanges 29 in said longitudinal direction D.

The return device 10 can therefore be activated freely without the flanges 29 being able to escape from the branches 15, 16 of the fork, even at the end of the longitudinal travel of the body 11 in the casing 1.

As shown in FIG. 1, the guide pins 26 are substantially centrally located in the openings 27 when the return device 10 is unoperated.

The device can be moved towards the top or towards the bottom of the casing 1 depending on the direction F or G in which the nut 6 turns.

The spring 18 is then compressed between a flange 29 on the casing 1 and the shoulders 21, 22 opposite that flange 29.

When the return device 10 is mounted on the casing 1 the circular oblong recess 23 flush with the side face 24 of the body 11 lines up with the cover 31 of the casing 1. The nut has a peripheral circular flange 32 adapted to rotate freely in the opening 23.

The diameter of the peripheral circular flange 32 is greater than the diameter of the body of the nut 6 and the flange is cast onto one face of the nut 6.

It makes the nut 6 more resistant to the forces applied to it to move the various locking members of the espagnolette-lock.

The nut 6 is preferably of simplified design.

Figure 11:
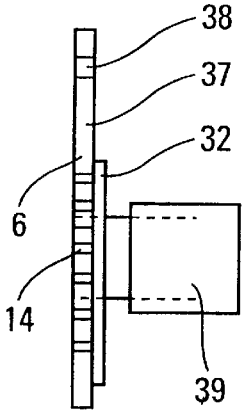
FIG. 11 shows the conventional mounting of a nut on an operating member.
Figure 8:
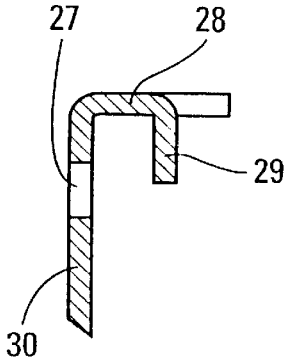
FIG. 8 is a view of the casing in section taken along the line VIII—VIII in FIG. 3.

It forms a unitary structure comprising the circular flange 32 and the teeth 14 extending partly over a peripheral ring of the nut 6 in a plane parallel to that defined by the circular flange 32 (see FIG. 11).

The circular flange 32 and the peripheral ring carrying the teeth 14 are concentric with the center 7 of the nut 6. The nut also has an angular sector 36 in the same plane as the peripheral ring of the teeth 14 and having a radius substantially equal to the distance between the center 7 of the nut and the front plate 33 of the casing 1.

The angular sector 36 generally subtends an angle in the range 45° to 90°.

A single cut portion 34 in the angular sector 36 is adapted to cooperate with a pin 35 attached to the bracket 4 adapted to operate the espagnolette rods 4*a*.

The disposition of the angular sector is such that in the locked position, i.e. with the rods 4*a* deployed from the casing 1, with the operating member 39 and the nut 6 at rest, the pin 35 on the bracket 4 abuts on one end of the cut portion 34 in the angular sector 36.

The length of the cut portion 34 along a circular arc that is also concentric with the center of the square pin 7 of the nut 6 is such that in the unlocked position the pin 35 on the bracket is at the center of the cut portion 34.

Furthermore, given the first direction F in which the nut 6 rotates, corresponding to lowering of the operating member 39, a side wall 37 of the angular sector 36 incorporates a notch 38 forming a finger adapted to cooperate with a finger on the tail 8 of the catch bolt 3 to move the latter against the return spring 9.

The distance between the front wall 37 and the finger 8 of the catch bolt is greater than or equal to half the length of the cut portion 34 in the angular sector 32.

Thus the espagnolette rods 4*a* and/or a lock bolt 3 mounted conventionally with a bracket 4 can be unlocked without operating the catch bolt 2.

Furthermore, in the unlocked position, when the pin 35 on the bracket 4 is centered in the cut portion 34, the catch bolt 2 is free so that if it is still held, for example by an open portion on the keeper, closing the door and absence of obstacles in the mechanism enable it to emerge from the lock front plate 33.

All that is required to relock the opening panel is to turn the operating member 39 in the opposite direction G, by raising the door handle, the bracket 4 locking the rods 4*a* and the lock bolt 3 in a manner that is known per se.

The above lock casing reduces the number of parts required for the espagnolette-lock mechanism both in terms of the nut and in terms of the device for returning the nut to the rest position associated with the operating member.

The unit price of the casing is therefore low.

Furthermore, fitting and assembly in production are simplified and enable faster production line throughputs.

Of course, the invention is not limited to the example that has just been described and many modifications can be made thereto without departing from the scope of the invention.

Thus, although the invention has been described in connection with an espagnolette-lock, the return device could equally be fitted to a conventional lock casing fitted to an opening panel.

There is claimed:

1. A return device for an operating member engaged with a nut, said device comprising a body having on a front face means adapted to cooperate with complementary means on said nut to convert rotation of said nut about an axis into longitudinal movement of said body, wherein the ends of said body comprising respective pairs of branches forming forks extending in the longitudinal direction of said body, said body has a longitudinal internal cavity adapted to accommodate a spring and open at both ends of said body, the width of said longitudinal internal cavity is greater than the distance between said branches of said forks, and said longitudinal internal cavity has at least one portion opening onto a rear face of said body and adapted to have said spring passed through said longitudinal internal cavity.

2. The return device claimed in claim 1 wherein said longitudinal internal cavity is a notch opening onto said rear face of said body and intersected by at least one bridge substantially transverse to said longitudinal direction of said body and shoulders are formed at the ends of said longitudinal internal cavity and form a constriction at the base of said branches of said forks adapted to hold said spring in said internal cavity.

3. The return device claimed in claim 1 wherein said front face includes a rack having teeth adjacent to a side face of said body and adapted to mesh with teeth on said nut.

4. The return device claimed in claim 3 wherein said body comprises a circular oblong recess in line with said teeth of said rack, flush with a side face of said body and adapted to be centered on the rotation center of said nut.

5. The return device claimed in claim 1 wherein side faces of said body include guide means adapted to cooperate with complementary guide means on a back and a cover of a casing accommodating said nut.

6. A casing for a lock, espagnolette-lock or the like, comprising at least one nut for actuating a catch bolt and a return device as claimed in any one of claims 1 to 5, wherein said rear edge of said casing has two flanges extending towards the interior of said casing and substantially parallel to the back of said casing, said flanges are adapted to be introduced between said branches forming respective forks of said body of said return device and the distance between said flanges of said rear edge of said casing is less than or equal to the length of said spring accommodated in said body when said spring is unstressed.

7. The casing claimed in claim 6 wherein said side faces of said body of said return device include at least one guide pin adapted to cooperate with an opening formed in said back and said cover of said casing and the distance between said flanges of said back of said casing is greater than or equal to the thickness of one branch of said forks of said body of said return device plus the thickness of said guide pin in a direction perpendicular to said side face of said body.

8. The casing claimed in claim 7 wherein the distance between said two branches of said fork of said body is greater than or equal to the thickness of said flanges plus the thickness of said guide pin in the direction perpendicular to said side face of said body.

9. The casing claimed in claim 7 wherein said openings cooperating with said guide pins have a length in said longitudinal direction in which said body moves less than or equal to the length of said branches of said fork plus the height of said flanges in said longitudinal direction.

10. The casing claimed in claim 7 wherein said guide pins are substantially in the middle of said openings when said return device is unoperated.

11. The casing claimed in claim 6 wherein said body of said return device has a circular oblong recess flush with the side face of said body adapted to face said cover of said casing and said nut has a peripheral circular flange adapted to be accommodated in said opening so that said flange is freely rotatable therein.

12. The casing claimed in claim 8 including a nut adapted to actuate movement in translation of a catch bolt and movement in translation of a bracket cooperating with at least one espagnolette rod emerging from said casing and/or with a lock bolt, wherein said nut has an angular sector incorporating cut portion adapted to cooperate with a pin attached to said bracket and a side wall, given a first direction of rotation of said nut, adapted to cooperate with a finger of a tail of said catch bolt to move said catch bolt against the action of a return spring and the distance between said side wall and said finger of said tail is greater than or equal to half the length of said opening.

* * * * *